US008864977B2

(12) United States Patent
Spicer

(10) Patent No.: US 8,864,977 B2
(45) Date of Patent: Oct. 21, 2014

(54) PROCESS FOR THE ON-STREAM DECOKING OF A FURNACE FOR CRACKING A HYDROCARBON FEED

(75) Inventor: David B. Spicer, Houston, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 1480 days.

(21) Appl. No.: 12/172,048

(22) Filed: Jul. 11, 2008

(65) Prior Publication Data

US 2010/0006478 A1 Jan. 14, 2010

(51) Int. Cl.
*C10G 9/16* (2006.01)

(52) U.S. Cl.
USPC ..... 208/48 Q; 208/48 R; 208/130; 585/648; 585/652

(58) Field of Classification Search
USPC ..... 208/48 Q, 130, 131, 48 R, 48 AA; 585/263, 648, 652
See application file for complete search history.

(56) References Cited

U.S. PATENT DOCUMENTS

| | | | | |
|---|---|---|---|---|
| 3,365,387 | A | 1/1968 | Cahn et al. | |
| 5,092,981 | A * | 3/1992 | Russo | 208/48 Q |
| 5,186,815 | A | 2/1993 | Lenglet | |
| 7,138,047 | B2 | 11/2006 | Stell et al. | |
| 2005/0209495 | A1 | 9/2005 | McCoy et al. | |
| 2005/0261530 | A1 * | 11/2005 | Stell et al. | 208/130 |

FOREIGN PATENT DOCUMENTS

| | | |
|---|---|---|
| GB | 1198873 | 7/1970 |
| GB | 1 306 962 | 2/1973 |
| WO | WO 98/55563 | 12/1998 |
| WO | WO2008/076531 | 6/2008 |

* cited by examiner

*Primary Examiner* — Prem C Singh
*Assistant Examiner* — Michelle Stein

(57) ABSTRACT

A process for the on-stream decoking of a steam cracking furnace, the steam cracking furnace including multiple tube banks positioned between a hydrocarbon feedstock inlet and a convection section to radiant section crossover, each tube bank including a plurality of tubes arranged within the tube bank, the process comprising the steps of terminating the flow of hydrocarbon feed to a portion of the plurality of tubes of less than all of the multiple tube banks, and supplying a decoking feed comprising steam to the portion of the plurality of tubes of less than all of the multiple tube banks in sufficient amount to effect removal of coke accumulated on the interior of the radiant coils and quench system components fed by such tubes while maintaining a temperature at the convection section to radiant section crossover of below about 788° C. A furnace for the production of ethylene is also provided.

8 Claims, 2 Drawing Sheets

PROCESS FOR THE ON-STREAM DECOKING OF A FURNACE FOR CRACKING A HYDROCARBON FEED

FIELD OF THE INVENTION

The present invention relates to the field of thermal cracking of hydrocarbons for the production of olefins, particularly low molecular weight olefins such as ethylene. More particularly this invention relates to the on-stream removal of coke deposits that form during such thermal cracking process.

BACKGROUND OF THE INVENTION

Steam cracking, also referred to as pyrolysis, is used to crack various hydrocarbon feedstocks into olefins, preferably light olefins such as ethylene, propylene, and butenes. Conventional steam cracking utilizes a pyrolysis furnace that has two main sections: a convection section and a radiant section. The hydrocarbon feedstock typically enters the convection section of the furnace as a liquid (except for light feedstocks which enter as a vapor) wherein it is heated and at least partially vaporized by indirect contact with hot flue gas from the radiant section and by direct contact with steam. The vaporized feedstock and steam mixture is then introduced into the radiant section where the cracking chemistry primarily takes place. The resulting products comprising olefins leave the pyrolysis furnace for further downstream processing, including quenching.

Olefin gas cracker systems are normally designed to crack ethane, propane and on occasion butane, but typically lack the flexibility to crack heavier liquid feedstocks, particularly those that produce tar in amounts greater than one percent. As gas feeds tend to produce little tar, primary, secondary, and even tertiary transfer line exchangers (TLEs) are utilized to recover energy through the generation of high pressure and medium pressure steam, as the furnace effluent cools from the furnace outlet to the quench tower inlet. The process gas is normally then fed to a quench tower wherein the process gas is further cooled by direct contacting with quench water.

Conventional steam cracking systems have also been effective for cracking high-quality liquid feedstocks which contain fully volatile hydrocarbons, such as gas oil and naphtha. Cracked effluent from furnaces processing these feeds can also be quenched in at least a primary TLE, although for heavier naphthas and all gas-oil feeds a secondary oil quench is often required downstream of the primary TLE. The process effluent from such furnaces is normally fed to a primary fractionator where heavy hydrocarbons are removed and a light hydrocarbon stream is passed to downstream units for further processing.

However, steam cracking economics sometimes favor cracking lower cost feedstocks containing resids such as, by way of non-limiting examples, atmospheric residue, e.g., atmospheric pipe still bottoms, and crude oil. Crude oil and atmospheric residue often contain high molecular weight, non-volatile components with boiling points in excess of 595° C. (1100° F.). The non-volatile components of these feedstocks gradually lay down as coke in the convection section of conventional pyrolysis furnaces. Only very low levels of non-volatile components can be tolerated in the convection section downstream of the point where the lighter components have fully vaporized. To crack feeds containing significant amounts of non-volatile material it is necessary to pass the partially preheated feed through a vapor-liquid separator, preferably at a temperature below that at which all the volatile hydrocarbons vaporize. Furnaces employing such a vapor-liquid separator are described in U.S. Pat. No. 7,138,047 and U.S. Patent Publication No. 2005/0209495 A1.

Cracking heavier feeds, such as kerosenes and gas oils, produces large amounts of tar, which leads to rapid coking in the radiant section and quench section of the furnace, leading to frequent feed interruptions to enable coke removal. This process is known as decoking. However, even the cracking of light gas feedstocks may result in the deposition of coke on the inside surfaces of the radiant coils and the need for periodic decoking.

Within the industry the normal method of removing coke from the radiant and quench systems of a cracking furnace is steam-air-decoking. During this process hydrocarbon feed is interrupted to the furnace and steam passes through the furnace. The furnace effluent is redirected from the recovery section of the olefins plant to a decoking system. Air is added to the steam passing through the furnace and the heated air/steam mixture removes the coke deposits by controlled combustion. While steam-air-decoking is effective at removing coke deposits from the radiant coil and quench systems of cracking furnaces, it has the drawback of requiring a complete cessation of olefins production from the furnace for the duration of the decoking process.

U.S. Pat. No. 3,365,387 proposes a process for removing coke from cracking furnace tubes by passing through one or more tubes a steam and/or water feed to decoke those tubes, while maintaining the furnace on stream. The steam and/or water feed is substituted for the hydrocarbon feed stock at the point where the hydrocarbon feedstock is introduced into the furnace. The advantage of this process over steam-air decoking is that the sections of the furnace not being decoked continue to produce olefins product and since no air or oxygen is added to the process, the furnace effluent does not need to be directed away from the recovery section of the olefins plant. This process, referred to as "on-stream decoking," therefore has the advantage of generating less variation in the olefins production rate of a given plant furnace section and also generates a lower workload for the plant operators since redirection of the entire furnace effluent is not required.

U.S. Pat. No. 3,557,241 proposes a process for removing coke from cracking furnace tubes by passing through at least one tube or tubes a decoking feed of steam and/or water and hydrogen, while maintaining the furnace on stream and continuing the thermal cracking process in tubes that are not being decoked. The steam and/or water and hydrogen feed is substituted for the hydrocarbon feed stock at the point where the hydrocarbon feedstock is introduced into the furnace.

While the two afore-mentioned patents describe on-stream-decoking techniques that eliminate many of the disadvantages of steam-air-decoking, the substitution of the steam/water mixture at the point where the feedstock is introduced to the furnace generates some drawbacks. Because the on-stream-decoking stream is introduced at the point where feed is introduced into the furnace, it must pass through the entire convection section process heating coils or banks. If the decoking stream is steam alone, then the temperature leaving the convection section and entering the radiant section of the furnace (known as the crossover temperature) is beyond the capacity of the materials commonly used in this section of the furnace. To keep the crossover temperature within the capacity of commonly used materials, it is necessary to add water to the steam. The presence of excessive water however, can generate mechanical problems if the water stratifies and runs along the bottom section of the heated convection tubes. Such phenomena can cause the tubes to bow, which restricts their free expansion and contraction within the tube supports (also known as tubesheets) within the convection section. Additionally, the requirement to add water to the decoking steam adds to the complexity of the pipe work and control system required on the furnace. What is desired is an on-stream decoking process and furnace design that does not require the use of water to keep convection section and crossover temperatures within the limitations of commonly used materials.

Despite advances in the art, there is a need for an improved process for the on-stream decoking of a pyrolysis furnace.

SUMMARY OF THE INVENTION

In one aspect, provided is a process for the on-stream decoking of a steam cracking furnace, the steam cracking furnace including multiple tube banks positioned between a hydrocarbon feedstock inlet and a convection section to radiant section crossover, each tube bank including a plurality of tubes arranged within the tube bank. The process includes the steps of terminating the flow of hydrocarbon feed to a portion of the plurality of tubes of less than all of the multiple tube banks, and supplying a decoking feed comprising steam to the portion of the plurality of tubes of less than all of the multiple tube banks in sufficient amount to effect removal of coke accumulated on the interior of the radiant coils and quench system components fed by such tubes while maintaining a temperature at the convection section to radiant section crossover of below about 788° C. (1450° F.).

In one form, the process further includes the steps of returning the portion of the plurality of tubes of less than all of the multiple tube banks to steam cracking operation, terminating the flow of hydrocarbon feed to a second portion of the plurality of tubes of less than all of the multiple tube banks and repeating the steps outlined above.

In another form, the feed is terminated and the decoking feed is supplied to a single tube of the plurality of tubes of less than all of the multiple tube banks at a time in order to remove coke from the radiant coils and quench system components fed by such tube without substantially reducing the conversion capacity of the furnace.

In yet another form, the temperature within the portion of the plurality of tubes of less than all of the multiple tube banks is about the same (within about ÷200° C.) as in the major portion of the plurality of tubes of less than all of the multiple tube banks remaining on-stream. In a further form the decoking feed consists essentially of steam. In still yet another form, the furnace is a steam cracking furnace.

In a yet further aspect, a process is provided for thermally cracking hydrocarbon materials by passing the same in admixture with steam through multiple tube banks sequentially positioned between a hydrocarbon feedstock inlet and a convection section to radiant section crossover, each tube bank including a plurality of tubes arranged within the tube bank, the multiple tube banks heated to an intermediate temperature in a convection section by contact with hot combustion gases and then subjected to radiant heat in a downstream radiant section. The process includes steps of terminating the flow of hydrocarbon feed to a portion of the plurality of tubes of less than all of the multiple tube banks, supplying a decoking feed comprising steam to the portion of the plurality of tubes of less than all of the multiple tube banks in sufficient amount to effect removal of coke accumulated on the interior of the radiant coils and quench system components fed by such tubes while maintaining a temperature at the convection section to radiant section crossover of below about 788° C. (1450° F.) and returning the portion of the plurality of tubes of less than all of the multiple tube banks to steam cracking operation.

In a further aspect, provided is a furnace for the production of ethylene, the furnace including a quench system. The furnace includes a convection section comprising multiple tube banks sequentially positioned between a hydrocarbon feedstock inlet and a convection section to radiant section crossover, each tube bank including a plurality of tubes arranged in parallel within the tube bank, a steam supply for on-stream decoking the radiant coils and quench system components fed by a portion of the plurality of tubes of less than all of the multiple tube banks, a valve for switching each of the plurality of tubes within less than all of the multiple tube banks from a source of hydrocarbon feed to steam from the steam supply and a radiant section in fluid communication with each of the plurality of tubes for thermal cracking of a hydrocarbon feedstock. These and other features will be apparent from the detailed description taken with reference to accompanying drawings.

BRIEF DESCRIPTION OF THE DRAWING

The invention is further explained in the description that follows with reference to the drawings illustrating, by way of non-limiting examples, various embodiments of the invention wherein.

DETAILED DESCRIPTION OF PREFERRED EMBODIMENTS

Various aspects will now be described with reference to specific embodiments selected for purposes of illustration. It will be appreciated that the spirit and scope of the process and system disclosed herein is not limited to the selected embodiments. Moreover, it is to be noted that the figures provided herein are not drawn to any particular proportion or scale, and that many variations can be made to the illustrated embodiments. Reference is now made to the figures, wherein like numerals are used to designate like parts throughout. When an amount, concentration, or other value or parameter is given as a list of upper preferable values and lower preferable values, this is to be understood as specifically disclosing all ranges formed from any pair of an upper preferred value and a lower preferred value, regardless whether ranges are separately disclosed. Feedstocks that may be employed herein may be any feedstock adapted for cracking insofar as they may be cracked into various olefins, and may contain heavy fractions such as high-boiling fractions and evaporation residuum fractions.

Figure 1:
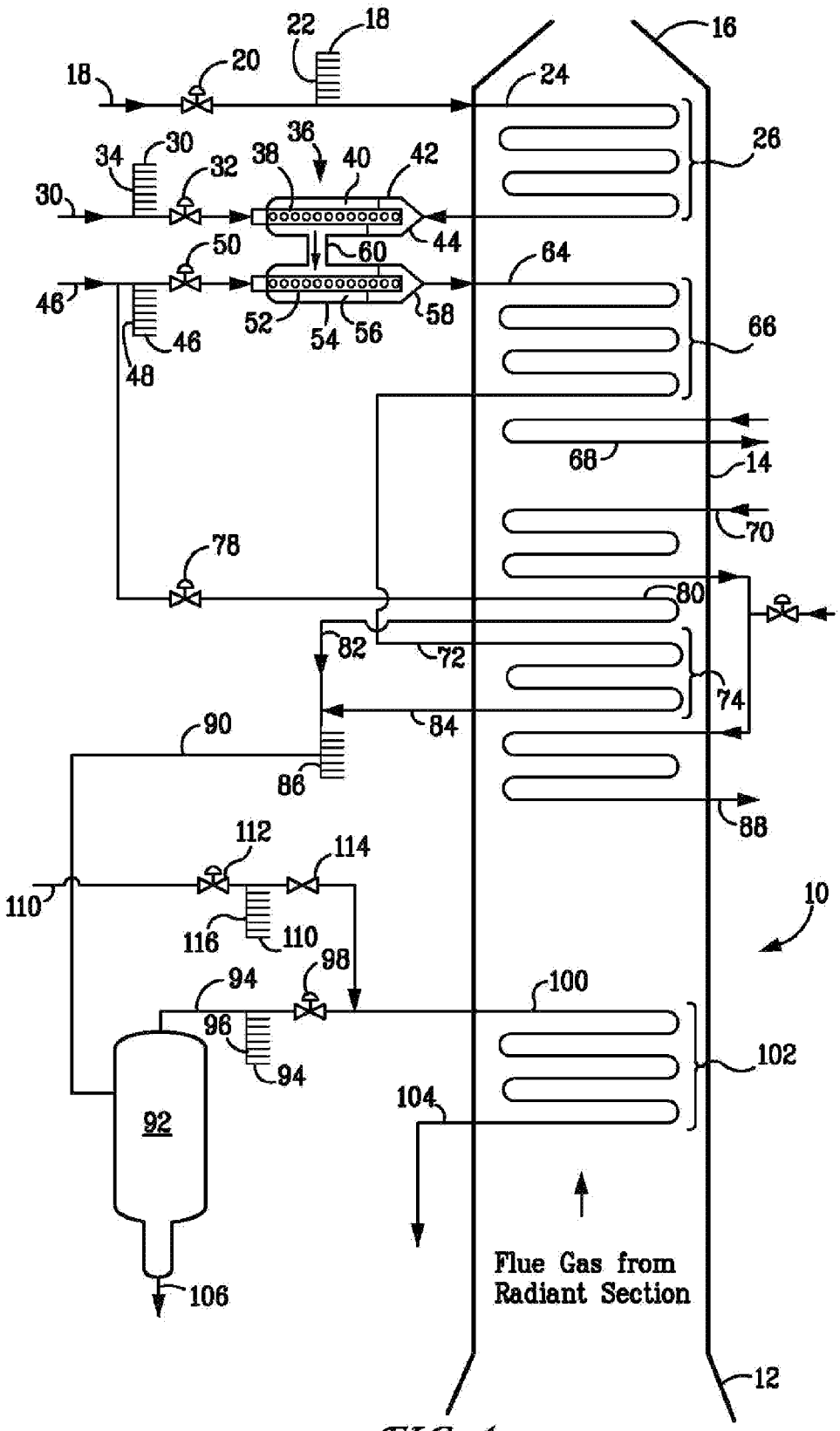
FIG. 1 illustrates a schematic flow diagram of a process as disclosed herein employed with a furnace, with particular emphasis on the convection section of the furnace.

FIG. 1 represents a pyrolysis furnace for cracking feed that contains a significant quantity of non-volatile material. Such a furnace may be as described in U.S. Pat. No. 7,138,047 and U.S. Patent Publication No. 2005/0209495 A1. Referring now to FIG. 1, a pyrolysis furnace 10 includes a lower radiant section 12, an intermediate convection section 14 and an upper flue gas exhaust section 16. In the radiant section 12, radiant burners (not shown) provide radiant heat to a hydrocarbon feed to produce the desired products by thermal cracking of the feed. The burners generate hot gas that flows upward through convection section 14 and out of the furnace 10 through flue gas exhaust section 16.

As shown in the FIG. 1, hydrocarbon feed enters an inlet tube 18, passes through inlet feed valve 20, and flows onward to an upper portion of the convection section 14 where it is preheated. As shown, a plurality of tubes 18 are arranged in parallel and represented schematically by external tube bank 22. Although not shown, each of the plurality of inlet tubes 18 may be provided with an inlet feed valve 20. As shown, each of the plurality of tubes 18 is in fluid communication with a corresponding heat exchange tube 24 of convection section tube bank 26. The use of the term "plurality of tubes" is meant to refer to the fact that the convection section 14 is arranged wherein each multiple tube bank has at least two tubes in parallel. As shown in FIG. 1, eight tubes are schematically represented, although furnaces having 3, 4, 6, 8, 10, 12, 16, 18 are known.

The preheating of the hydrocarbon feed can take any form known by those of ordinary skill in the art. Generally, the heating includes indirect contact of the feed in the upper convection section 14 of the furnace 10 with hot flue gases from the radiant section 12 of the furnace 10. This can be accomplished, by way of non-limiting example, by passing the feed through the heat exchange tubes located within the convection section 14 of the furnace 10.

After the preheated hydrocarbon feed exits the convection section 14, water may be introduced to the preheated hydrocarbon feed through line 30 and dilution steam may be introduced through line 46 to form a mixture. As may be appreciated, a plurality of water lines 30 may be arranged in parallel and are represented schematically by external bank 34. Likewise, a plurality of steam lines 46 may be arranged in parallel and are represented schematically by external bank 48. Water may be added to the preheated feed in an amount of from at least about 0% to 100% based on the total amount of water and dilution steam added by weight. It is understood that, in accordance with one form, 100% water could be added to the hydrocarbon feed such that no dilution steam is added. The sum of the weight of the water flow and the dilution steam flow provides the total desired reaction zone $H_2O$ required to achieve the desired hydrocarbon partial pressure.

As shown in FIG. 1, water may be added to the preheated feed prior to addition of dilution steam. It is believed that this order of addition may reduce undesirable pressure fluctuations in the process stream originating from mixing the hydrocarbon feed, water and dilution steam. As may be appreciated by those skilled in the art, such fluctuations are commonly referred to as a water-hammer or steam-hammer. While the addition of water and dilution steam to the preheated hydrocarbon feed could be accomplished using any known mixing device, it is preferred to use a sparger assembly 36. Water is preferably added in a first sparger 44. As shown, first sparger 44 comprises an inner perforated conduit 38 surrounded by an outer conduit 42 so as to form an annular flow space 40 between the inner and outer conduits 38 and 42, respectively. The preheated hydrocarbon feed flows through an annular flow space. Also preferably, water flows through the inner perforated conduit 38 and is injected into the preheated hydrocarbon feed through the openings (perforations) shown in inner conduit 38. As may be appreciated, a plurality of sparger assemblies 36 may be arranged in parallel.

Dilution steam may be introduced through line 46 to the preheated hydrocarbon feed in a second sparger 58. As shown, second sparger 58 includes an inner perforated conduit 52 surrounded by an outer conduit 54 so as to form an annular flow space 56 between the inner and outer conduits 52 and 54, respectively. The preheated hydrocarbon feed to which the water has been added flows through the annular flow space 56. Thereafter, dilution steam flows through the inner perforated conduit 52 and is injected into the preheated hydrocarbon feed through the openings (perforations) shown in inner conduit 52.

In another form, the first and second spargers 44 and 58, respectively, are part of a sparger assembly 36, as shown, in which the first and second spargers 44 and 58, respectively, are connected in fluid flow communication in series. The first and second spargers 44 and 58 are interconnected in fluid flow communication in series by fluid flow interconnector 60. Such a sparger assembly for mixing water and dilution steam with preheated hydrocarbon feed is described in U.S. Pat. No. 7,090,765.

As further illustrated, upon exiting the sparger assembly 36, the mixture of hydrocarbon feed, water and dilution steam flows back into furnace 10 through heat exchange tube 64 of tube bank 66 wherein the mixture is further heated within a lower portion of convection section 14. The further heating of the hydrocarbon feed can take any form known by those of ordinary skill in the art. The further heating may include indirect contact of the feed in convection section 14 of the furnace 10 with hot flue gases from the radiant section 12 of the furnace. This can be accomplished, by way of non-limiting example, by passing the feed through the plurality of heat exchange tubes 64 located within tube bank 66 of the convection section 14 of the furnace 10. Following the additional heating of the mixture within tube bank 66, the resulting heated mixture exits the convection section 14, bypassing the superheated high pressure steam section 70 and then may flow back into furnace 10 through heat exchange tube 72 of tube bank 74, wherein the mixture is further heated within a still lower portion of convection section 14.

The mixture of hydrocarbon feed, water and dilution steam exits the convection section again at tube 84 and bypasses the downstream superheated high pressure steam section and export 88. The mixture flows to one or more tubes 90 and is fed to a flash separation vessel 92 for separation. As may be appreciated, one or more tubes 90 are arranged in parallel and are fed by a plurality of tubes 84, represented schematically by external bank 86. An overhead portion may be removed via line 94, pass through valve 98 and returned to furnace 10 through heat exchange tube 100 of tube bank 102 wherein the mixture is further heated within a lower portion of convection section 14. Once again, a plurality of lines 94 are provided and arranged in parallel and are represented schematically by external bank 96.

Upon exiting the convection section 14 again at tube 104 the heated hydrocarbon is passed to the radiant section of the furnace for thermal cracking of the hydrocarbon. The heated feed to the radiant section may have a temperature between about 425° C. to about 760° C. (about 800° F. to about 1400° F.) or about 560 to about 730° C. (about 1050° F. to about 1350° F.).

As may be appreciated, in a typical pyrolysis furnace 10, the area in the convection section 14 for process preheat and vaporization is more than that required to preheat to 790° C., the addition of steam required for on-stream decoking to prevent heating beyond the limits of the piping. This is particularly true for heavy liquid feed furnaces with direct oil quench, and thus no transfer line exchanger (TLE), with steam that would otherwise be superheated in the convection section 14 as shown in exemplary FIG. 1.

In hydrocarbon operation, for example, the feed may be preheated in multiple tube bank 26. Dilution steam may be added and further preheating conducted in multiple tube bank 66. As shown in FIG. 1, the process "jumps" around a high pressure boiler feed water (HPBFW) 68 and steam superheat bank 70 and is further preheated in bank 74. At this point the partially vaporized feed from the various passes are combined and fed to a vapor-liquid separator 92. The vapor product from the vapor-liquid separator is distributed back into the plurality of tubes 94 (eight are depicted schematically by 96 in the case presented in FIG. 1) through a plurality of control valves 98 and is returned for final preheat in bank 102 before passing to the radiant section for cracking.

Advantageously, the herein disclosed process of passing the on-stream decoking stream through only a fraction of the process preheating area makes it possible to eliminate the use of water (in addition to the steam) in the on-stream decoking operation, while staying within the temperature limitations of the crossover piping 104. As disclosed herein, the remainder of the process preheating area can be kept in process preheat duty. As may be appreciated, the configuration of exemplary FIG. 1 illustrates a furnace that meets this requirement and is designed for cracking heavy liquid feeds containing a non-volatile fraction.

In accordance herewith, in one form, an inventive process for the on-stream decoking of a furnace 10 is provided, the furnace 10 including multiple tube banks 26, 66, 74 and 102 serially positioned between a hydrocarbon feedstock inlet 18 and a radiant section crossover 104, each tube bank 26, 66, 74 and 102 including a plurality of tubes 24, 64, 80 and 100, respectively, arranged in parallel within each tube bank 26, 66, 74 and 102. The process includes the steps of terminating the flow of hydrocarbon feed to a portion of the plurality of tubes 24, 64, 80 and 100 of less than all of the multiple tube banks 26, 66, 74 and 102, supplying a decoking feed comprising steam to the portion of the plurality of tubes 24, 64, 80 and 100 of less than all of the multiple tube banks 26, 66, 74 and 102 to effect removal of coke accumulated on the interior of the convection coils, the radiant coils, and quench system components, fed by such convection tubes while maintaining a temperature at the convection section to radiant section crossover 104 of below about 1450° F.; and returning the portion of the plurality of tubes 24, 64, 80 and 100 of less than all of the multiple tube banks 26, 66, 74 and 102 to hydrocarbon processing operation after decoking.

The inventive process also includes the steps of terminating the flow of hydrocarbon feed to a portion of the plurality of tubes 24, 64, 80 and 100 of less than all of the multiple tube banks 26, 66, 74 and 102, supplying a decoking feed consisting essentially of steam to the portion of the plurality of tubes 24, 64, 80 and 100 of less than all of the multiple tube banks 26, 66, 74 and 102 to effect removal of coke accumulated on the interior of the radiant coils and quench system components fed by such convection tubes while maintaining a temperature at the convection section to radiant section crossover 104 of below about 1450° F.; and returning the portion of the plurality of tubes 24, 64, 80 and 100 of less than all of the multiple tube banks 26, 66, 74 and 102 to hydrocarbon processing operation.

By the use of the term "portion of the plurality of tubes" is meant to refer to at least one and less than all of the plurality of tubes. By the use of the term "less than all of the multiple tube banks" is meant to refer to at least one and less than all of the multiple tube banks.

In practice, a portion of the plurality of tubes 24, 64, 80 and 100 of less than all of the multiple tube banks 26, 66, 74 and 102 are taken off stream, without shutting down the furnace 10, by cutting out the normal feed thereto at valves and passing a decoking feed through the tube or tubes 20 in sufficient amount to remove the coke from the interior of the radiant coils and quench components fed by such tubes. After decoking, the tube or tubes 20 are returned to normal flow by cutting out the decoking feed and returning the decoked tube or tubes to normal service.

Steam for use in decoking is made available and controlled through one or more control valves 112. The decoking steam may be passed through any of the plurality of valves 114 to a point downstream of the plurality of control valves 98 of the tube or tubes in question. When a single control valve 112 is used, the decoking steam may be lined up to any of the convection passes using gate valves 114. When a tube is undergoing an on-stream decoking operation conducted in accordance herewith, the respective valve 98 is closed and the vapor overhead product from the vapor-liquid separator is fed only to the remaining tubes of the plurality of tubes (in the exemplary case represented by FIG. 1, seven of the eight tubes of convection bank 102 and the radiant section). However, as may be appreciated, all of the plurality of tubes 24, 64 and 80 of convection banks 26, 66 and 74 remain in process preheat service.

Figure 2:
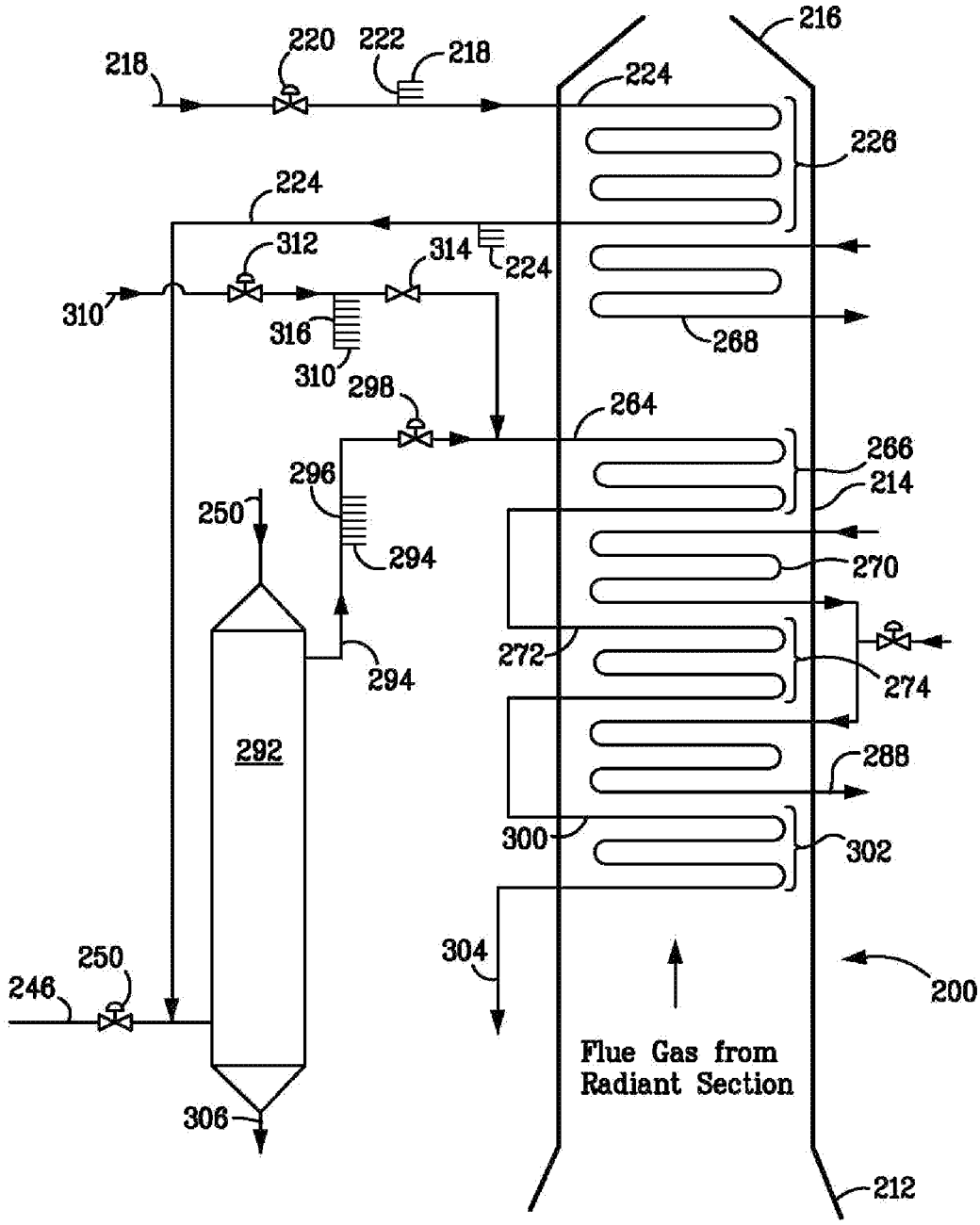
FIG. 2 illustrates another schematic flow diagram of a process as disclosed herein employed with a furnace, again, with particular emphasis on the convection section of the furnace.

Reference is now made to exemplary FIG. 2, wherein a furnace 200 for cracking gas feeds such as ethane or propane is configured in accordance herewith. Furnace 200 includes a lower radiant section 212, an intermediate convection section 214, and an upper flue gas exhaust section 216. In the radiant section 212, radiant burners (not shown) provide radiant heat to a hydrocarbon feed to produce the desired products by thermal cracking of the feed. The burners generate hot gas that flows upwardly through convection section 214 and then out of the furnace 200 through flue gas exhaust section 216.

As illustrated in exemplary FIG. 2, hydrocarbon feed may enter an inlet tube 218, pass through inlet feed valve 220, and flow onward to an upper portion of the convection section 214 where it is preheated. As shown, a plurality of tubes 218 may be arranged in parallel and represented schematically by external tube bank 222. Although not shown, each of the plurality of tubes 218 may be provided with an inlet feed valve 220, or the arrangement may use a single feed valve as shown. As illustrated, each of the plurality of tubes 218 is in fluid communication with a corresponding heat exchange tube 224 of convection section tube bank 226.

Preheating of the hydrocarbon feed can take any form known by those of ordinary skill in the art. Generally, the heating includes indirect contact of the feed in the upper convection section 214 of the furnace 200 with hot flue gases from the radiant section 212 of the furnace 200. This can be accomplished, by way of non-limiting example, by passing the feed through the heat exchange tubes located within the convection section 214 of the furnace 200. Upon exiting tube bank 226, the preheated feed may have a temperature between about 95° C. to about 315° C. (about 200° F. to about 600° F.) or between about 150° C. to about 260° C. (about 300° F. to about 500° F.) or between about 175° C. to about 260° C. (about 350° F. to about 500° F.).

After the preheated hydrocarbon feed exits the upper convection section 214, dilution steam may be introduced through line 246 to form a mixture. Dilution steam is added by weight or an amount of at least about 20% (i.e., about 20% to about 100%) based on dilution steam by weight or at least about 25% or at least about 30%, based on dilution steam by weight.

As further illustrated in exemplary FIG. 2, the mixture of hydrocarbon feed and dilution steam flows into a transfer line exchanger (TLE) 292, such as a secondary TLE, and is heated by hot furnace effluent gases 250. The heated mixture of hydrocarbon feed and dilution steam leaves the exchanger through line 294. The cooled furnace effluent gases leave the exchanger through line 306. The plurality of tubes 294 feed a corresponding plurality of heat exchange tubes 264 of tube bank 266 with the flow to each of the plurality of tubes controlled by control valves 298, wherein the mixture is further heated within a lower portion of convection section 214. The further heating of the hydrocarbon feed can take any form known by those of ordinary skill in the art. The further heating may include indirect contact of the feed in convection section 214 of the furnace 200 with hot flue gases from the radiant section 212 of the furnace. This can be accomplished, by way of non-limiting example, by passing the feed through the plurality of heat exchange tubes 264 located within tube bank 266 of the convection section 214 of the furnace 200. Following the additional heating of the mixture within tube bank 266, the resulting heated mixture exits the convection section 214, bypassing the superheated high pressure steam section 270 and then may flow back into furnace 200 through heat exchange tube 272 of tube bank 274, wherein the mixture is further heated within a still lower portion of convection section 214.

The mixture of hydrocarbon feed and dilution steam exits the convection section 214 again and bypasses the downstream superheated high pressure steam section and export 288. The mixture flows is returned to furnace 200 through heat exchange tube 300 of tube bank 302 wherein the mixture is further heated within a lower portion of convection section 214.

Upon exiting the convection section 214 again at tube 304 the heated hydrocarbon is passed to the radiant section 212 of the furnace 200 for thermal cracking of the hydrocarbon. The heated feed to the radiant section may have a temperature between about 425° C. to about 760° C. (about 800° F. to about 1400° F.) or about 560 to about 730° C. (about 1050° F. to about 1350° F.).

In heavy hydrocarbon cracking operation, coke builds up on the internal surfaces of the radiant tubes and reduces the effective cross-sectional area of the tube, thereby necessitating higher pressures to maintain a constant throughput. Since coke is an effective insulator, its formation on tube walls also must be accompanied by an increase in furnace tube temperature to maintain cracking efficiency. High operating temperatures, however, result in a decrease in tube life, which limits the practical temperature that can be employed, as well as the ultimate conversion and yield.

Advantageously, the herein disclosed process and apparatus that passes the on-stream decoking stream through only a fraction of the process preheating area makes it possible to eliminate the use of water in the on-stream decoking operation, while staying within the temperature limitations of the crossover piping 304. As disclosed herein, the remainder of the process preheating area can be kept in process preheat duty.

As illustrated, the convection section 214 may be arranged in banks of tubes. In each bank there are several tubes in parallel (eight are depicted schematically in FIG. 2, with the exception of multiple tube bank 226, which is shown to have four, although furnaces with 3, 4, 6, 8, 10, 12, 16, and 18 are known). As may be appreciated, each pass consists of a serpentine arrangement of tubes. Multiple tube banks 226, 266, 274 and 302 are all process preheat banks in the convection section 214.

In the form depicted in exemplary FIG. 2, decoking steam may be controlled through control valve 312. The decoking steam may be passed through any of the valves 314 to a point downstream of valve 298. When a tube is undergoing on-stream decoking service, the respective valve 298 is closed, and the feed and dilution steam mixture is fed to remaining tubes of convection banks 266, 274 and 302 and the radiant section 212. As may be appreciated, all tubes of convection bank 226 and the total area of the secondary TLE 292 remain in process preheat service.

EXAMPLE

In this Example a system as depicted in exemplary FIG. 1 is employed. Decoking steam is provided and controlled through control valve 112. The decoking steam may be passed through any of the valves 114 to a point downstream of valve 98. A valve 98 is closed for a corresponding tube 94 for on-stream decoking the radiant coils and quench system components that are fed by that tube. Vapor overhead product from the vapor-liquid separator 92 is fed to the other seven tubes of convection bank 102 and the radiant section 12. All tubes of convection banks 26, 66, and 74 remain in process preheat service.

Satisfactory decoking is achieved when the operation is conducted in accordance herewith. All patents, test procedures, and other documents cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the invention, including all features which would be treated as equivalents thereof by those skilled in the art to which the invention pertains.

International Claims

1. A process for the on-stream decoking of a furnace having a quench system, the furnace including multiple tube banks positioned between a hydrocarbon feedstock inlet and a radiant section crossover, the radiant section including radiant coils, each tube bank including a plurality of tubes arranged within the tube bank, the process comprising the steps of:

(a) terminating the flow of hydrocarbon feed to a portion of the plurality of tubes of less than all of the multiple tube banks; and (b) supplying a decoking feed comprising steam to the portion of the plurality of tubes of less than all of the multiple tube banks of step (a) to effect removal of coke accumulated on the interior of radiant coils and quench system components fed by such tubes while maintaining a temperature at the convection section to radiant section crossover of below about 788° C.

2. The process of claim 1, further comprising:

(c) returning the portion of the plurality of tubes of less than all of the multiple tube banks of step (a) to hydrocarbon processing operation;

(d) terminating the flow of hydrocarbon feed to a second portion of the plurality of tubes of less than all of the multiple tube banks; and (e) repeating steps (b) and (c).

3. The process of any preceding claim, wherein the feed is terminated and the decoking feed is supplied to a single tube of the plurality of tubes of less than all of the multiple tube banks at a time in order to remove coke from the radiant coils and quench system components fed by such tube without substantially reducing the conversion capacity of the furnace.

4. The process of any preceding claim, wherein the hydrocarbon feed terminated in step (a) comprises a vapor stream from a vapor/liquid separator.

5. The process of any of claims 1, 2 or 3, wherein the hydrocarbon feed terminated in step (a) comprises a vapor stream from a secondary transfer line exchanger.

6. The process of any preceding claim, wherein the decoking feed supplied in step (b) does not include added water.

7. The process of any preceding claim, wherein the temperature within the portion of the plurality of tubes of less than all of the multiple tube banks during step (b) is within about +/−200° C. of the plurality of tubes of less than all of the multiple tube banks remaining on-stream.

8. The process of any preceding claim, wherein the furnace is a steam cracking furnace.

9. The process of any preceding claim, wherein the decoking feed supplied in step (b) consists essentially of steam.

10. The process of any preceding claim, wherein the furnace for comprises a convection section comprising multiple tube banks sequentially positioned between a hydrocarbon feedstock inlet and a convection section to radiant section crossover, each tube bank including a plurality of tubes arranged within the tube bank; a radiant section in fluid communication with each of the plurality of tubes for thermal cracking of a hydrocarbon feedstock; a steam supply for on-stream decoking the radiant coils and quench system components fed by a portion of the plurality of tubes of less than all of the multiple tube banks; and a valve for switching each of the plurality of tubes within less than all of the multiple tube banks from a source of hydrocarbon feed to steam from said steam supply.

11. The process of claim 10, wherein the hydrocarbon feed is terminated and the steam is supplied to a single tube of the plurality of tubes of less than all of the multiple tube banks in order to remove coke from the radiant coils and quench system components fed by such tube without substantially reducing the conversion capacity of the steam cracking furnace.

12. The process of claims 10 or 11, further comprising a vapor/liquid separator.

13. The process of claim 10 or 11, further comprising a secondary transfer line exchanger.

What is claimed is:

1. A process for the on-stream decoking of a furnace having a convection section, a radiant section, a crossover from the convection section to the radiant section, and a quench system, the process comprising the steps of:

(a) providing a hydrocarbon feed to a first portion of the convection section via a plurality of tubes of a first tube bank to produce a pre-heated hydrocarbon feed;

(b) removing the pre-heated hydrocarbon feed from the furnace;

(c) providing the pre-heated hydrocarbon feed to a second portion of the convection section via a plurality of tubes of a second tube bank to produce a heated hydrocarbon feed, wherein the second tube bank is located downstream of the first tube bank;

(d) removing the heated hydrocarbon feed from the furnace;

(e) providing the heated hydrocarbon feed to a third portion of the convection section via a plurality of tubes of a third tube bank to produce a re-heated hydrocarbon feed, wherein the third tube bank is located downstream of the second tube bank;

(f) removing the re-heated hydrocarbon feed from the furnace;

(g) separating from the removed re-heated hydrocarbon feed an overhead stream, and then providing the overhead stream to a fourth portion of the convection section via a plurality of tubes of a fourth tube bank to produce a heated overhead stream, wherein the fourth tube bank is located downstream of the third tube bank;

(h) selecting at least one but fewer than all of the first, second, third, and fourth tube banks, and terminating hydrocarbon flow to a portion of the plurality of tubes of the selected tube banks; and (i) supplying a decoking feed comprising steam to the portion of the plurality of tubes of the selected tube banks to effect removal of coke accumulated on the interior of radiant coils and quench system components fed by such tubes while maintaining a temperature at the convection section to radiant section crossover of below about 788° C.

2. The process of claim 1, further comprising:

(j) returning the portion of the plurality of tubes of the selected tube banks of step (g) to hydrocarbon processing operation;

(k) selecting at least one tube bank from among those not selected in step (h);

(l) terminating hydrocarbon flow to a portion of the plurality of tubes of the tube banks selected in step (k); and (m) supplying a decoking feed comprising steam to the portion of the plurality of tubes of the tube banks selected in step (k) to effect removal of coke accumulated on the interior of radiant coils and quench system components fed by such tubes while maintaining a temperature at the convection section to radiant section crossover of below about 788° C.

3. The process of claim 1, wherein the hydrocarbon flow is terminated and the decoking feed is supplied to a single tube of selected tube banks at a time in order to remove coke from the radiant coils and quench system components fed by such tube without substantially reducing the conversion capacity of the furnace.

4. The process of claim 1, wherein the tube bank selected in step (h) includes the fourth tube bank.

5. The process of claim 1, wherein the tube bank selected in step (h) is the fourth tube bank only.

6. The process of claim 1, wherein the decoking feed supplied in step (i) does not include added water.

7. The process of claim 1, wherein the temperature within the portion of the plurality of tubes of the selected tube banks during step (h) is within about +/−200° C. of the plurality of tubes of the multiple tube banks remaining on-stream.

8. The process of claim 1, wherein the furnace is a steam cracking furnace, and wherein step (b) includes combining steam and/or water with the pre-heated hydrocarbon feed after the removing of the pre-heated hydrocarbon feed from the furnace.

* * * * *